US007892022B2

(12) United States Patent
Mostoller et al.

(10) Patent No.: US 7,892,022 B2
(45) Date of Patent: Feb. 22, 2011

(54) JUMPER CONNECTOR FOR A LIGHTING ASSEMBLY

(75) Inventors: Matthew Edward Mostoller, Hummelstown, PA (US); Charles Raymond Gingrich, III, Mechanicsburg, PA (US); Nazareth Wayne Eppley, West Fairview, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 191 days.

(21) Appl. No.: 12/366,819

(22) Filed: Feb. 6, 2009

(65) Prior Publication Data

US 2010/0203757 A1 Aug. 12, 2010

(51) Int. Cl.
*H01R 31/08* (2006.01)

(52) U.S. Cl. ..... 439/507; 439/65

(58) Field of Classification Search ..... 439/65, 439/507, 509–514

See application file for complete search history.

(56) References Cited

U.S. PATENT DOCUMENTS

| | | | | |
|---|---|---|---|---|
| 5,321,203 | A * | 6/1994 | Goto et al. | 439/509 |
| 6,299,469 | B1 * | 10/2001 | Glovatsky et al. | 439/329 |
| 6,641,284 | B2 | 11/2003 | Stopa et al. | |
| 6,659,623 | B2 * | 12/2003 | Friend | 362/249.06 |
| 6,666,713 | B1 * | 12/2003 | Norvelle | 439/507 |
| 6,802,626 | B2 | 10/2004 | Belfer et al. | |
| 6,882,111 | B2 | 4/2005 | Kan et al. | |
| 7,021,946 | B2 | 4/2006 | Koizumi et al. | |
| 7,165,863 | B1 * | 1/2007 | Thomas et al. | 362/219 |
| 7,273,987 | B2 | 9/2007 | Becker et al. | |
| 7,311,420 | B2 | 12/2007 | Tan et al. | |
| 7,341,476 | B2 * | 3/2008 | Soeta | 439/493 |
| 7,364,346 | B2 | 4/2008 | Uhler et al. | |
| 7,462,036 | B2 * | 12/2008 | Shin et al. | 439/65 |
| 2006/0094289 | A1 * | 5/2006 | Kim et al. | 439/500 |
| 2008/0128739 | A1 | 6/2008 | Sanpei et al. | |

OTHER PUBLICATIONS

LED Professional: LEDs lighting Technology, Citizen Electronics, 3pgs.

Development of high power white LED for illumination: CL-L102-C7 Series; A combination of high luminous flux (540 lm) and high efficiency (74 lm/W), Citizen Holdings Co., Ltd., Sep. 4, 2007, 2 pgs.

Specification Sheet, CL-L102-C7D, Citizens Electronic Co., Ltd:, Dec. 17, 2007, 10 pgs.

* cited by examiner

*Primary Examiner*—Edwin A. Leon
*Assistant Examiner*—Vanessa Girardi

(57) ABSTRACT

A jumper connector for connecting lighting components to one another includes a connector body having a mating surface configured to engage more than one lighting component, where the connector body is configured to be secured to a substrate by a fastener. The jumper connector also includes a conductor held by the body, wherein the conductor is configured to be electrically connected to more than one lighting component during the same manufacturing step in which the connector body is secured to the substrate.

19 Claims, 8 Drawing Sheets

JUMPER CONNECTOR FOR A LIGHTING ASSEMBLY

BACKGROUND OF THE INVENTION

The subject matter herein relates generally to lighting assemblies, and more particularly, to jumper connectors for lighting assemblies.

Light-emitting diodes ("LEDs") are now widely applied in a variety of lighting applications. The relatively high efficacy of LEDs (in lumens per watt) is the primary reason for their popularity. Power savings are possible when LED's are used to replace traditional incandescent lighting. One aspect of LED technology that has proven problematic is the efficient management and removal of waste heat. The waste heat results in degraded performance and reduced device life. Typically, to remove waste heat, a heat sink or other heat dissipating device is utilized.

An example of lighting components in use today that utilizes LEDs is the CL-L102 Series of lighting components, commercially available from Citizen Electronics Co. Such lighting components include an elongated circuit board having one or more LED's mounted thereto that is surrounded by a phosphor material to control the illumination. Such lighting components are used for general lighting purposes. Typically, the circuit board is mounted to a heat sink to dissipate heat generated by the LEDs. A screw is used to hold the circuit board to the heat sink. In some applications, multiple lighting components are utilized and arranged in series as a lighting strip, where the circuit boards are aligned along the heat sink or another substrate and secured thereto by the screws. The circuit boards are electrically connected to one another by wires that are soldered between adjacent circuit boards. Power is supplied from one board to the next by the wires. The wires are typically soldered after the circuit boards are secured to the substrate. The multiple assembly steps of individually securing the lighting components to the substrate and then electrically connecting the string of lighting components with wires is time consuming.

Another approach is to provide thermally conductive substrates on which the lighting components are mounted. These substrates generally perform a function of mechanical support, also provide for electrical interconnection to and between components, and assist in the extraction and dissipation of heat generated by the lighting components. These substrates often are costly or require complicated multi-step manufacturing processes.

There exists a continued need to provide interconnect structures for lighting assemblies that allow for rapid heat dissipation and are cost effective and simple to make.

BRIEF DESCRIPTION OF THE INVENTION

In one embodiment, a jumper connector is provided for connecting lighting components to one another. The jumper connector includes a connector body having a mating surface configured to engage more than one lighting component, where the connector body is configured to be secured to a substrate by a fastener. The jumper connector also includes a conductor held by the body, wherein the conductor is configured to be electrically connected to more than one lighting component during the same manufacturing step in which the connector body is secured to the substrate.

Optionally, the conductor may engage contact pads on the lighting components when the connector body is secured to the substrate. The conductor may create a power circuit between the lighting components such that power is configured to flow between the lighting components via the conductor. The substrate may constitute a heat sink. The fastener may engage the connector body and the heat sink to simultaneously secure the lighting components to the heat sink such that the lighting components are in thermal communication with the heat sink. The fastener may pass between adjacent lighting components and engage the connector body to secure the connector body to the substrate. As the fastener is tightened the lighting components may be forced against the substrate by the connector body.

In another embodiment, a lighting assembly is provided that includes first and second lighting components each including a circuit board extending along a longitudinal axis between opposed end portions, a contact pad provided at one or more of the end portions, and a lighting device connected to the circuit board and electrically connected to at least one contact pad by the circuit board. A jumper connector is coupled between the first and second lighting components. The jumper connector has a first mating interface engaging one of the end portions of the first lighting component, and a second mating interface engaging one of the end portions of the second lighting component. The jumper connector has a conductor extending between the first and second mating interfaces. The conductor engages conductive pads of both the first lighting component and the second lighting component to create an electrical circuit between the conductive pads of the first lighting component and the second lighting component. The jumper connector and first and second lighting components are configured to be secured to a common substrate.

In a further embodiment, a jumper connector is provided for connecting lighting components to one another, where each lighting component has a circuit board with a lighting device mounted thereto and a contact pad thereon. The jumper connector includes a connector body extending between opposed ends, and the connector body having a mating surface configured to engage more than one lighting component. The jumper connector also includes a conductor held by the body, where the conductor is configured to be electrically connected to contact pads of more than one lighting component such that the conductor creates a power path for transmitting power therebetween. A fastener engages the connector body and is configured to secure the connector body to a substrate when the fastener engages the substrate. The connector body is configured to simultaneously secure more than one lighting component to the substrate when the fastener engages the substrate.

DETAILED DESCRIPTION OF THE INVENTION

Figure 1:
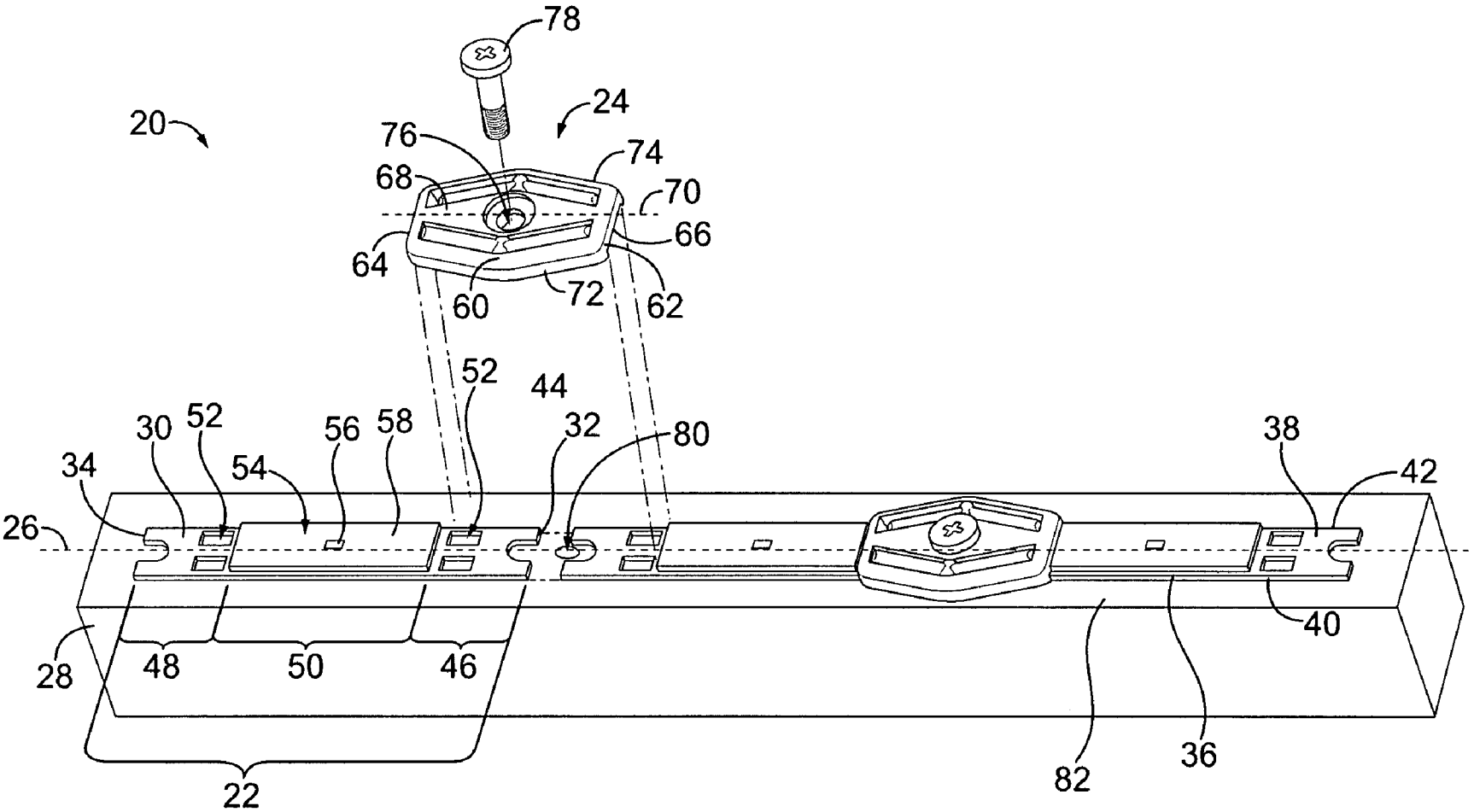
FIG. 1 illustrates a lighting assembly including multiple lighting components interconnected by jumper connectors.

FIG. 1 illustrates a lighting assembly 20 including multiple lighting components 22 interconnected by jumper connectors 24. The lighting components 22 are arranged in a row along a component axis 26 to form a lighting strip. Any number of lighting components 22 may be used to form the lighting strip. The lighting components 22 are connected in series by the jumper connectors 24, and the jumper connectors 24 form part of an electrical circuit that transmits power between adjacent lighting components 22, as will be described in further detail below.

The lighting components 22 are secured to a substrate 28. In an exemplary embodiment, the jumper connectors 24 are used to secure the lighting components 22 to the substrate 28. In the illustrated embodiment, the substrate 28 constitutes a heat sink, and may be referred to hereinafter as heat sink 28. The heat sink 28 dissipates heat generated by the lighting components 22 during operation.

In exemplary embodiment, the lighting components 22 are substantially identically formed. Each lighting component 22 includes a circuit board 30 extending longitudinally along the component axis 26. The circuit board 30 extends between opposed first and second ends 32, 34. The circuit board 30 includes an inner surface 36 that generally faces the substrate 28 and an outer surface 38 that faces away from the substrate 28. The inner and outer surfaces 36, 38 are generally planar and are elongated along the component axis 26 between the ends 32, 34. The circuit board 30 includes opposed first and second sides 40, 42 that extend between the ends 32, 34 and that extend between the inner and outer surfaces 36, 38.

In an exemplary embodiment, the circuit board 30 includes an opening 44 at each end 32, 34. Each lighting components 22 is arranged end-to-end with an adjacent lighting component 22 such that the openings 44 thereof are aligned with one another to form a common opening. The common opening may have an elongated, noncircular shape.

The circuit board 30 includes a first mating end portion 46 at the first end 32, a second mating end portion 48 at the second end 34 and a lighting device mounting portion 50 between the mating end portions 46, 48. One or more contact pads 52 may be provided at each mating end portion 46, 48. The contact pads 52 are exposed along the outer surface 38 of the circuit board 30. As will be described in further detail below, the contact pads 52 provide an electrical connection with the jumper connector 24 when the jumper connector 24 is connected to the lighting component 22. In the illustrated embodiment, two conductive pads 52 are provided at each mating end portion 46, 48.

One or more lighting devices 54 are electrically connected to the circuit board 30. The lighting devices 54 are operated when power is applied to the circuit board 30 by the jumper connector 24. Optionally, the circuit board 30 may include one or more electrical components, such as controllers, transistors, microprocessors, capacitors, resistors and the like for controlling the power supplied to the lighting devices 54. In an exemplary embodiment, each lighting device 54 includes one or more light emitting diodes (LEDs) 56. Optionally, the LEDs 56 may be surrounded by a phosphor material 58 or other material to control illumination. Other types of lighting elements may be used in alternative embodiments. The LEDs 56 may be directly or indirectly connected to the circuit board 30. The LEDs 56 may be electrically connected to one or more of the contact pads 52 by traces or other conductors of the circuit board 30. Heat generated by the LEDs 56 and/or other electrical components connected to the circuit board 30 may be dissipated by the heat sink 28 when the lighting component 22 is mounted to the heat sink 28.

The jumper connectors 24 both mechanically secure a pair of adjacent lighting components 22 to the substrate 28, as well as electrically interconnect the pair of adjacent lighting components 22 to one another. A power circuit is created by the jumper connector 24 to transmit power from one lighting component 22 to another lighting component 22. During assembly, the jumper connector 24 may make electrical connection with the lighting components 22 while at the same time, or during the same assembly operation, physically securing the lighting components 22 to the substrate 28.

The jumper connector 24 includes a dielectric connector body 60. In an exemplary embodiment, the connector body 60 is a unitary one-piece body. The connector body 60 extends between opposed first and second ends 62, 64. The connector body 60 includes a mating surface 66 that generally faces the lighting components 22 and an outer surface 68 that faces away from the lighting components 22. The mating and outer surfaces 66, 68 are elongated along a longitudinal connector axis 70 between the ends 62, 64. The connector axis 70 is generally parallel to the component axis 26 when the jumper connector 24 is coupled to the lighting components 22. The connector body 60 includes opposed first and second sides 72, 74 that extend between the ends 62, 64 and that extend between the mating and outer surfaces 66, 68. The connector body 60 includes an opening 76 therethrough. The opening 76 may be substantially centered between the ends 62, 64 and the sides 72, 74.

A fastener 78 is used to secure the jumper connector 24 to the substrate 28. In an exemplary embodiment, the fastener 78 is represented by a threaded fastener, such as a screw, that is received in a threaded bore 80 in the substrate 28. As such, the fastener 78 is threadably coupled to the substrate 28. However, in alternative embodiments, different types of fasteners may be used to secure the jumper connector 24 to the substrate 28.

During assembly, the jumper connector 24 is placed on top of a pair of adjacent lighting components 22 such that the jumper connector 24 engages end portions 46, 48 of the adjacent lighting components 22. The fastener 78 is positioned with respect to the jumper connector 24 to secure the jumper connector 24 to the substrate 28. The fastener 78 is moved to a securing position in which the jumper connector 24 is secured to the substrate 28. In the illustrated embodiment, the fastener 78 is rotated or tightened to the securing position in which the jumper connector 24 is securely coupled to the substrate 28. When the jumper connector 24 is securely coupled to the substrate 28 the lighting components 22 are likewise secured to the substrate 28 by the jumper connector 24. For example, the jumper connector 24 may sandwich or otherwise hold the lighting components 22 between the mating surface 66 of the jumper connector 24 and a mating surface 82 of the substrate. In an exemplary embodiment, each end 32, 34 of the lighting component 22 is held by a different jumper connector 24. The jumper connectors 24 are releasably coupled to the lighting components 22 such that the jumper connectors 24 may be removed to free the lighting components 22 from the substrate 28. The jumper connector 24 may be released from the lighting components 22 such that both the jumper connector 24 and the lighting components 22 may be reversed. The jumper connector 24 may be released from the lighting components 22 in a single step of removing the fastener 78.

Figure 2:
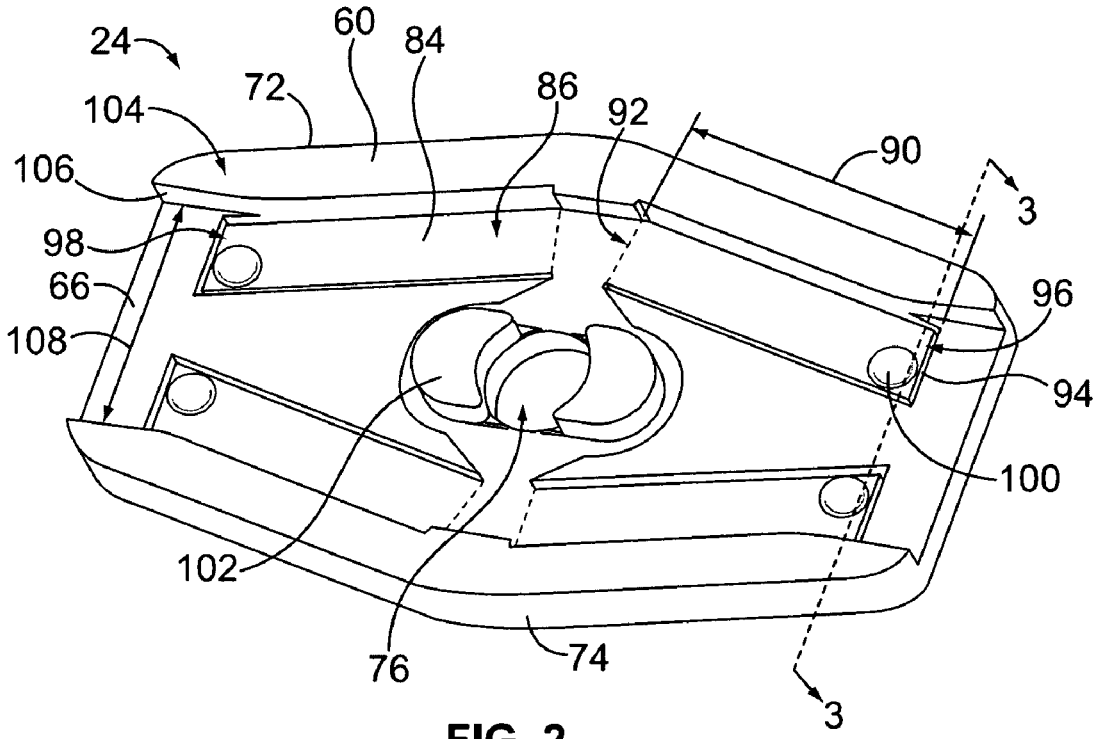
FIG. 2 is a bottom perspective view of the jumper connector shown in FIG. 1.

FIG. 2 is a bottom perspective view of the jumper connector 24 illustrating the mating surface 66. The jumper connector 24 includes at least one conductor 84 held by the connector body 60. In the illustrated embodiment, the conductor 84 is formed by a plating material 86 that plates flexible beams 88 (shown in FIG. 3) defined by portions of the connector body 60. The beams 88 (e.g. the structure underneath the plating material 86) have a beam length 90 between a fixed end 92 and a free end 94 of the beam 88. The beams 88 are flexible and may be deflected, such as when mated to the lighting components 22 (showing FIG. 1). In the illustrated embodiment, two conductor portions are shown extending near corresponding sides 72, 74 of the connector body 60, and the two conductor portions are interconnected by plating material 86 in the central region of the connector body 60. In alternative embodiments, the two conductor portions may be separate from one another and define two separate conductors 84. Any number of conductors may be defined by and/or held by the jumper connector 24.

The conductor 84 extends between a first mating interface 96 of the jumper connector 24 at the first end 62 thereof and a second mating interface 98 of the jumper connector 24 at the second end 64 thereof. In an exemplary embodiment, the conductor 84 defines a unitary continuous conductive element between the first and second mating interfaces 96, 98. In an exemplary embodiment, the conductor 84 includes buttons 100 in the mating interfaces 96, 98. The buttons 100 project outward from immediately adjacent portions thereof. The buttons 100 are coated with the plating material 86 and define a portion of the conductor 84 that engages the contact pads 52 (shown in FIG. 1) of the lighting components 22. The buttons 100 protrude beyond the mating surface 66 to ensure proper electrical connection with the contact pads 52.

The jumper connector 24 includes one or more mounting tabs 102 extending therefrom. The mounting tabs 102 extend outward from the mating surface 66. The mounting tabs 102 surround portions of the opening 76 through the connector body 60. During assembly, when the jumper connector 24 is positioned with respect to the lighting components 22, the mounting tabs 102 fit within the openings 44 (shown in FIG. 1) of the lighting components 22. The mounting tabs 1602 may be sized and shaped to properly position the jumper connector 24 with respect to the lighting components 22, such as to align the conductor 84 with the contact pads 52.

The jumper connector 24 includes standoffs 104 that extend from the mating surface 66 at the sides 72, 74 of the connector body 60. The standoffs 104 have shoulders 106 that engage corresponding sides 40, 42 (shown in FIG. 1) of the lighting component 22. The shoulders 106 may be separated by a distance 108 substantially equal to a width of the lighting component 22 such that the shoulders 106 engage both sides 40, 42 of the lighting component 22. The standoffs 104 are used to orient or position the jumper connector 24 with respect to lighting components 22.

Figure 3:
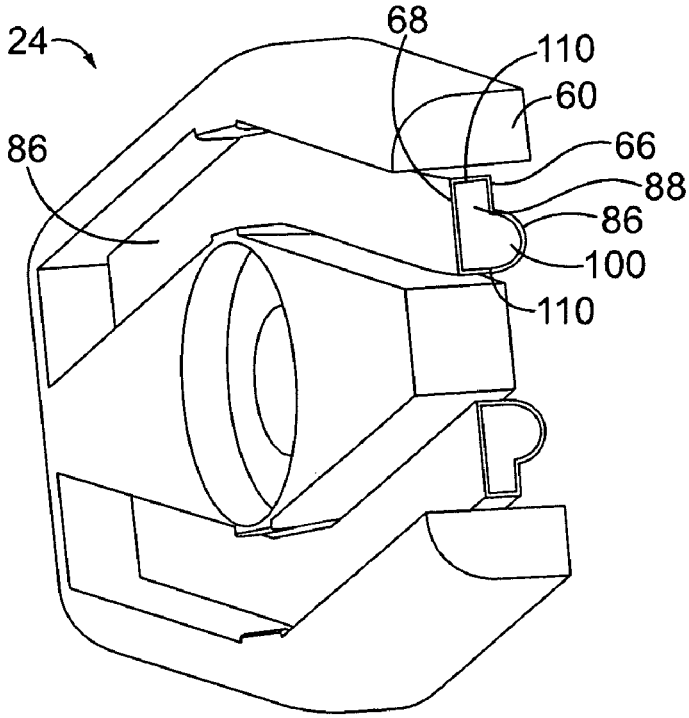
FIG. 3 is a sectional view of the jumper connector shown in FIG. 1.

FIG. 3 is a sectional view of the jumper connector 24 taken along line 3-3 shown in FIG. 2. The section is taken through the buttons 100. FIG. 3 illustrates the beams 88, which are fabricated from a dielectric material and formed as part of the connector body 60. The buttons 100 are formed integral with the beam 88 during the same manufacturing process. The buttons 100 define curved outer surfaces that are covered by the plating material 86.

The plating material 86 covers select portions of the beams 88 to define a conductive path between the first and second mating interfaces 96, 98 (shown in FIG. 2). In the illustrated embodiment, the plating material 86 covers the mating surface 66 of the beams 88, the outer surface 68 of the beams 88 and side walls 110 of the beams 88. The side walls 110 extend between the mating and outer surfaces 66, 68. The beams 88 are entirely coated with the plating material 86. In alternative embodiments, only select portions of the beams 88 may be coated with the plating material 86. By coating the outer surface 68 of the beams 88 and the side walls 110 of the beams 88, the beams 88 may be stiffened as compared to an embodiment in which the outer surface 68 and the side walls 110 of the beams 88 are not covered. By having stiffened beams 88, the beams 88 have a greater spring force to resist flexing or deflecting during assembly with the lighting components 22 (shown in FIG. 1). The beams 88 may provide adequate engagement force when mated with the lighting components 22.

Figure 4:
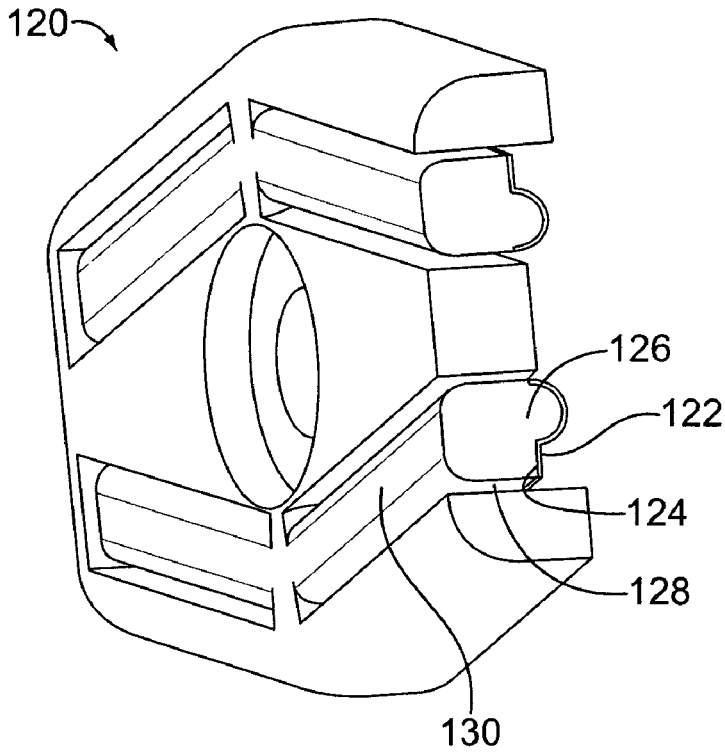
FIG. 4 is a sectional view of an alternative jumper connector for the lighting assembly shown in FIG. 1.

FIG. 4 is a sectional view of an alternative jumper connector 120 for the lighting assembly 20 (shown in FIG. 1) that is sectioned through a similar portion of the jumper connector 120 as shown in FIG. 3. The jumper connector 120 is similar to the jumper connector 24 (shown in FIG. 3) and includes similar parts and features. At least one of the differences between the jumper connector 120 and the jumper connector 24 is that the jumper connector 120 includes plating material 122 only on a mating surface 124 of beams 126 of the jumper connector 120. Side walls 128 and an outer surface 130 of the beams 126 are not coated with the plating material 122. Additionally, the beams 126 are thicker than the beams 88 (shown in FIG. 3) of the jumper connector 24. The thickness of the beams 126 stiffens the beams 126 as compared to beams that are thinner. Less plating material 122 is required when only plating the mating surface 124.

Figure 5:
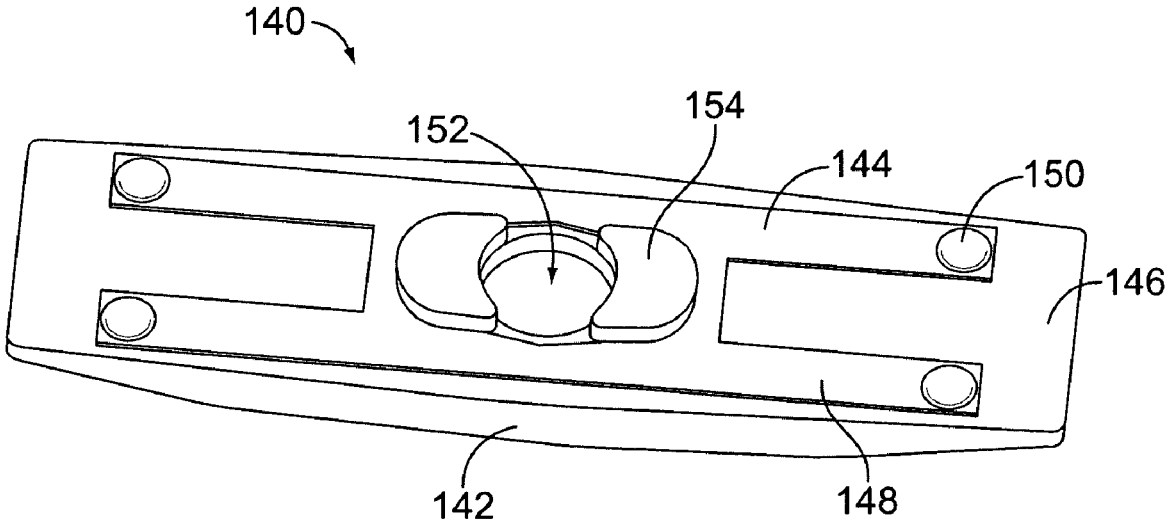
FIG. 5 is a bottom perspective view of another alternative jumper connector for the lighting assembly shown in FIG. 1.

FIG. 5 is a bottom perspective view of another alternative jumper connector 140 for the lighting assembly 20 (shown in FIG. 1). The jumper connector 140 includes a connector body 142 and a conductor 144. The connector body 142 includes a mating surface 146 and the conductor 144 is provided on the mating surface 146.

The conductor 144 is represented by a plating material 148 that plates selected portions of the mating surface 146. In an exemplary embodiment, buttons 150 are formed by the conductor 144 and/or the connector body 142. The buttons 150 extend outward from the mating surface 146. The buttons 150 are semi-spherical in shape, but may have other shapes in alternative embodiments.

The connector body 142 includes an opening 152 therethrough. Mounting tabs 154 are provided proximate to the opening 152. The mounting tabs 154 extend outward from the mating surface 146.

Figure 6:
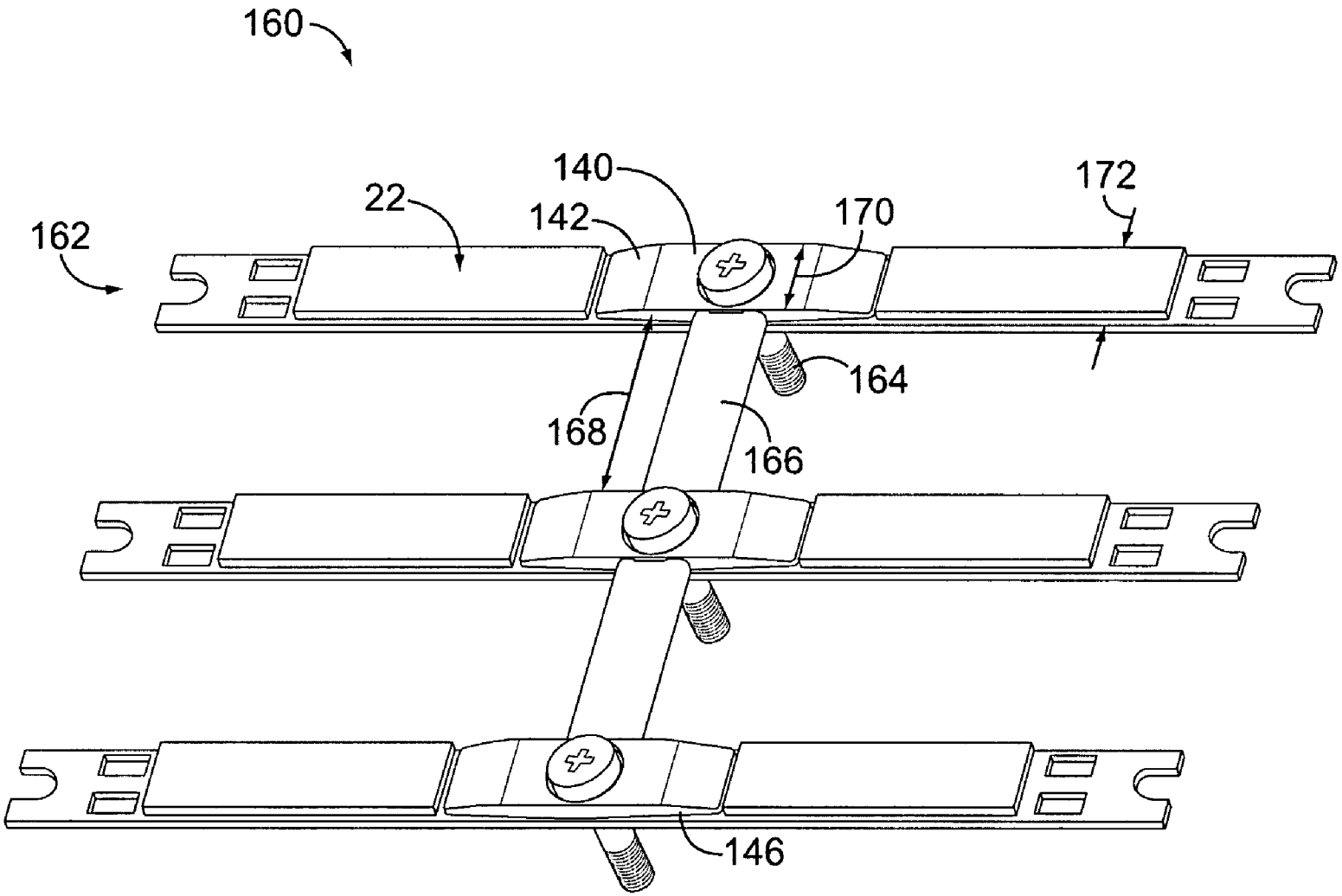
FIG. 6 illustrates an alternative lighting assembly using the jumper connectors shown in FIG. 5.

FIG. 6 illustrates an alternative lighting assembly 160 using the jumper connectors 140. The lighting assembly 160 includes a plurality of lighting components 22 that are arranged in more than one row 162. The rows 162 of lighting components form multiple, parallel lighting strips. Any number of lighting components 22 may be arranged in each row 162, even though only two lighting components 22 are illustrated in each row 162 in FIG. 6. Any number of rows 162 of lighting components 22 may be provided, even though only three rows 162 are illustrated in FIG. 6.

Jumper connectors 140 are provided between adjacent lighting components 22 in each row 162. The jumper connectors 140 create power paths that transmit power between adjacent lighting components 22. Fasteners 164 engage the jumper connectors 140 to secure the jumper connectors 140 and the lighting components 22 to one or more substrates (not shown). Each row 162 of lighting components 22 and corresponding jumper connectors 140 may be mounted to a different substrate. Alternatively, more than one row 162 of lighting components 22 and corresponding jumper connectors 140 may be mounted to the same substrate. The size of the substrate and the spacing between the rows 162 may affect the substrate mounting configuration.

The jumper connectors 140 are interconnected by bridges 166 that extend between and connect the jumper connectors 140 to one another. The bridges 166 may be integrally formed with the connector bodies 142 of more than one jumper connector 140 during a manufacturing process. Alternatively, the bridges 166 may be separately connected to one or more of the jumper connectors 140 during an assembly process. Once the bridges 166 are connected to multiple jumper connectors 140, the jumper connectors 140 may be handled as a single unit. The bridges 166 space the jumper connectors 140 apart by a predetermined spacing 168. Optionally, the spacing 168 may be the same between each jumper connector 140, and thus each row 162 of lighting components 22. Alternatively, bridges 166 of different lengths may be used between the various jumper connectors 140 to change the spacing 168 between the jumper connectors 140 and thus the rows 162 of lighting components 22.

In the illustrated embodiment, the jumper connectors 140 have a width 170 that is less than a width 172 of the lighting components 22. As such, the jumper connectors 140 do not have an impact on the form factor of the lighting components 22.

The connector body 142 of the jumper connectors 140 may be at least partially deflectable. When the fastener 164 is secured to the substrate and the mating surface 146 engages the lighting assemblies 22, the buttons 150 (shown in FIG. 5) engage the contact pads 52 (shown in FIG. 1) of the lighting assemblies 22. The connector body 142 may slightly bend or bow when the fastener 164 is tightened. When the fastener 164 is tightened to the securing position, the jumper connector 140 makes electrical contact with both lighting components 22 and at the same time secures both lighting components 22 to the substrate. The electrical connection and mechanical securing are accomplished during the same manufacturing step of tightening the fastener 164 to the securing position.

Figure 7:
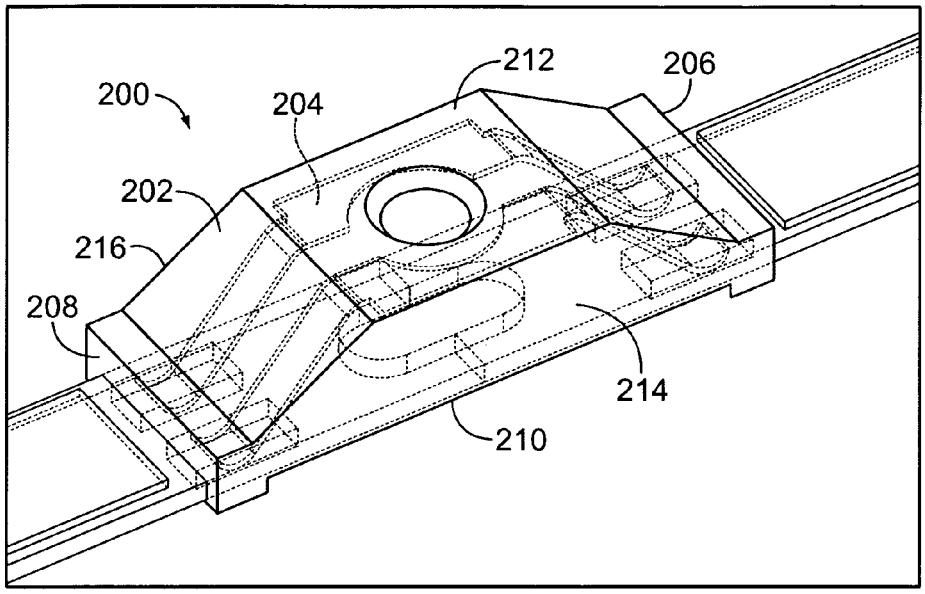
FIG. 7 is a top perspective view of yet another alternative jumper connector for the lighting assembly shown in FIG. 1.

FIG. 7 is a top perspective view of yet another alternative jumper connector 200 for the lighting assembly 20, a portion of which is shown in FIG. 7. The jumper connector 200 is used to electrically connect two adjacent lighting components 22 to one another. The jumper connector 200 is used to secure both lighting components 22 to the substrate 28 (shown in FIG. 1).

The jumper connector 200 includes a connector body 202 and conductors 204 (shown in phantom in FIG. 7). The connector body 202 extends between opposed first and second ends 206, 208. The connector body 202 includes a mating surface 210 that generally faces the lighting components 22 and an outer surface 212 that faces away from the lighting components 22. The connector body 202 includes opposed first and second sides 214, 216 that extend between the ends 206, 208 and that extend between the mating and outer surfaces 210, 212. The connector body 202 includes an opening 218 therethrough. The opening 218 may be substantially centered between the ends 206, 208 and the sides 214, 216. A fastener such as the fastener 78 (shown in FIG. 1) is used to secure the jumper connector 200 to the substrate 28. The fastener 78 is received in the opening 218 and engages the outer surface 212 to secure the jumper connector 200 to the substrate 28.

The conductors 204 are held by the connector body 202 and are exposed at the mating surface 210 to engage the contact pads 52 (shown in phantom). The conductors 204 extend between the ends 206, 208 to electrically connect the two adjacent lighting components 22 to one another.

Figure 8:
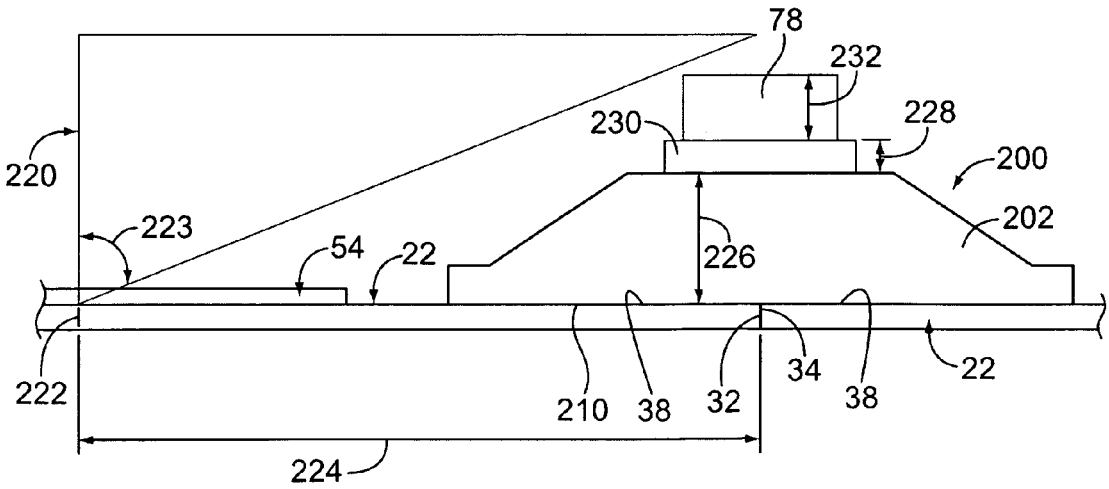
FIG. 8 is a side view of a portion of the lighting assembly with the jumper connector shown in FIG. 7.

FIG. 8 is a side view of a portion of the lighting assembly 20 with the jumper connector 200 interconnecting adjacent lighting components 22. The ends 32, 34 of the adjacent lighting components 22 abut one another and the jumper connector 200 is substantially centered over the ends 32, 34 thereof. When the jumper connector 200 is mounted to the lighting components 22 by the fastener 78, the mating surface 210 is flush with and rests upon the outer surfaces 38 of the lighting components 22.

A light cone 220 is illustrated in FIG. 8 emanating from a center 222 of the lighting device 54. The light cone 220 has a half-angle of illumination 223 shown in FIG. 8 measured from vertical toward the jumper connector 200. The center 222 of the lighting device 54 is positioned a distance 224 from the end 32 of the lighting component 22. The connector body 202 has a height 226 selected such that the jumper connector 200 does not interfere with the light cone 220, and thus does not detrimentally block the light produced by the lighting device 54. The height 226 is selected taking in to consideration the additional height 228 of any washers 230 between the connector body 202 and the fastener 78 as well as the additional height 232 of the fastener 78 above the connector body 202. The half-angle of illumination 223 as well as the distance 224 have an impact on the height 226 of the connector body 202.

Figure 9:
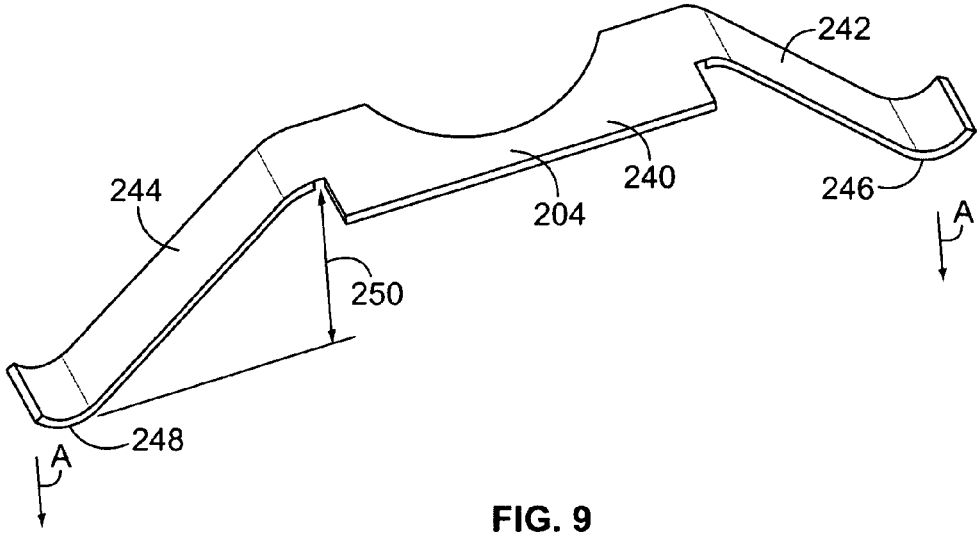
FIG. 9 is a perspective view of a conductor for use with the jumper connector shown in FIG. 7.

FIG. 9 is a perspective view of one of the conductors 204 for use with the jumper connector 200. The conductor 204 includes a base 240 and two opposed arms 242, 244 extending downward from the base 240. In an exemplary embodiment, the arms 242, 244 are deflectable and define spring arms that provide a downward spring force in the direction of arrows A. The arms 242, 244 define first and second mating interfaces 246, 248, respectively, of the conductor 204. In an exemplary embodiment, the arms 242, 244 are curved proximate to the distal ends thereof to define the mating interfaces 246, 248 near the distal ends of the arms 242, 244.

The first mating interface 246 is configured to electrically engage a contact pad 52 (shown in FIG. 7) of one lighting component 22 (shown in FIG. 7). The second mating interface 246 is configured to electrically engage a contact pad 52 of a different lighting component 22. As such, the conductor 204 creates an electrical path between the two different lighting components 22. The first and second mating interfaces 246, 248 are positioned a distance 250 below the base 240. The arms 242, 244 may be deflected upward toward the plane defined by the base 240 during mating with the lighting components.

In an exemplary embodiment, the conductor 204 is stamped from a blank and then formed by bending portions of the conductor 204 into a final shape.

Figure 10:
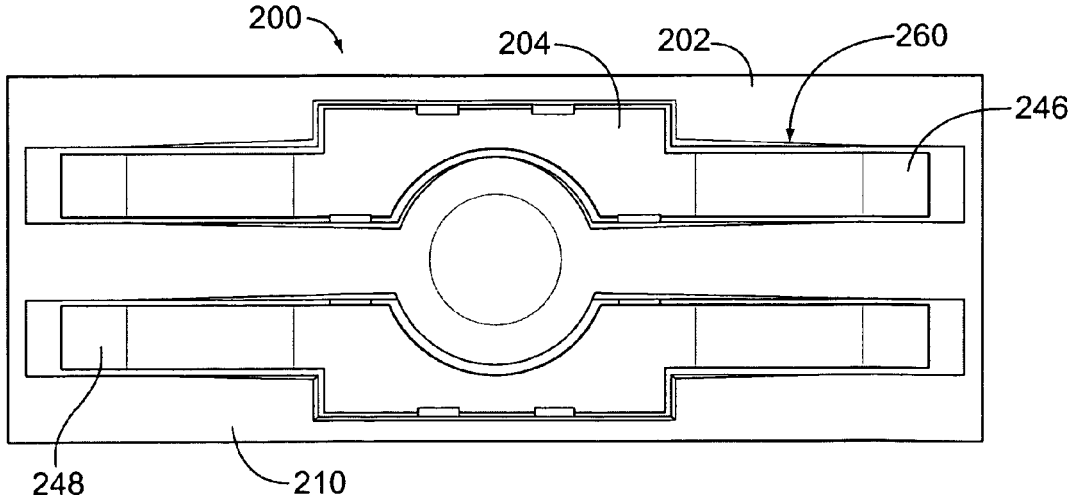
FIG. 10 is a bottom view of the jumper connector shown in FIG. 7.

FIG. 10 is a bottom view of the jumper connector 200 illustrating two conductors 204 held within the connector body 202. While two conductors 204 are illustrated, it is realized that any number of conductors may be utilized. Additionally, while the conductors 204 are separate from one another, it is realized that the conductors 204 may engage one another or be linked by some other conductive element therebetween.

The connector body 202 includes channels 260 formed therein. The conductors 204 are held in the channels 260 such that the mating interfaces 246, 248 are provided proximate to the mating surface 210. In an exemplary embodiment, the conductors 204 emerge slightly from the channels 260 such that the mating interfaces 246, 248 are exposed below the bottom of the mating surface 210 for engagement with the contact pads 52 (shown in FIG. 7) of the lighting components 22 (shown in FIG. 7).

Figure 11:
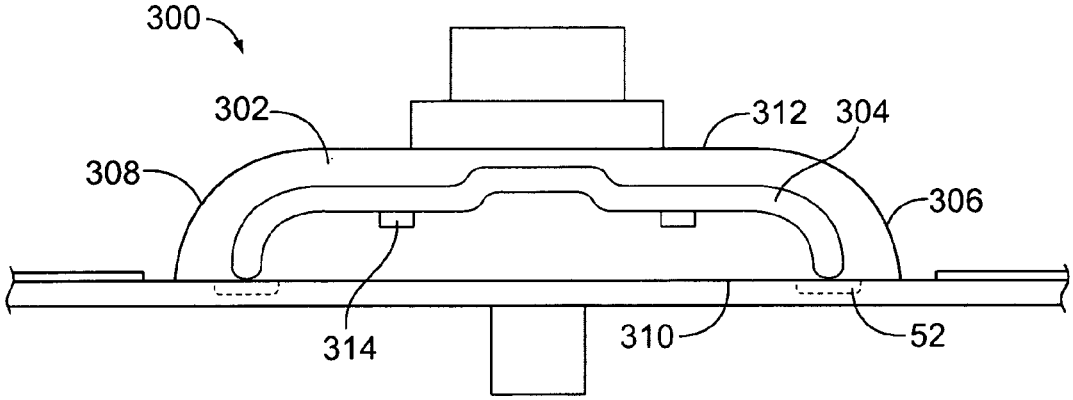
FIG. 11 is a side view of a portion of the lighting assembly with another alternative jumper connector.

FIG. 11 is a side view of a portion another alternative jumper connector 300 for the lighting assembly 20, a portion of which is, shown in FIG. 11. The jumper connector 300 is used to electrically connect two adjacent lighting components 22 to one another. The jumper connector 300 is used to secure both lighting components 22 to the substrate 28 (shown in FIG. 1).

The jumper connector 300 includes a connector body 302 and one or more conductors 304 (shown in phantom in FIG. 11). The connector body 302 extends between opposed first and second ends 306, 308. The connector body 302 includes a mating surface 310 that generally faces the lighting components 22 and an outer surface 312 that faces away from the lighting components 22. A fastener such as the fastener 78 (shown in FIG. 1) is used to secure the jumper connector 300 to the substrate 28. The fastener 78 engages the outer surface 312 to secure the jumper connector 300 to the substrate 28.

The conductors 304 are held within dedicated channels (not shown) formed in the connector body 302. The channels are open at the mating surface 310 and the conductors 304 are loaded into the channels through the mating surface 310 during an assembly process. Retention ribs 314 (shown in phantom in FIG. 11) extend partially into the channels and engage the conductors 304 to hold the conductors 304 in the channels. The conductors 304 are held within the connector body 302 such that the conductors 304 are exposed at the mating surface 310 to engage the contact pads 52 (shown in phantom). The conductors 304 extend between the ends 306, 308 to electrically connect the two adjacent lighting components 22 to one another.

Figure 12:
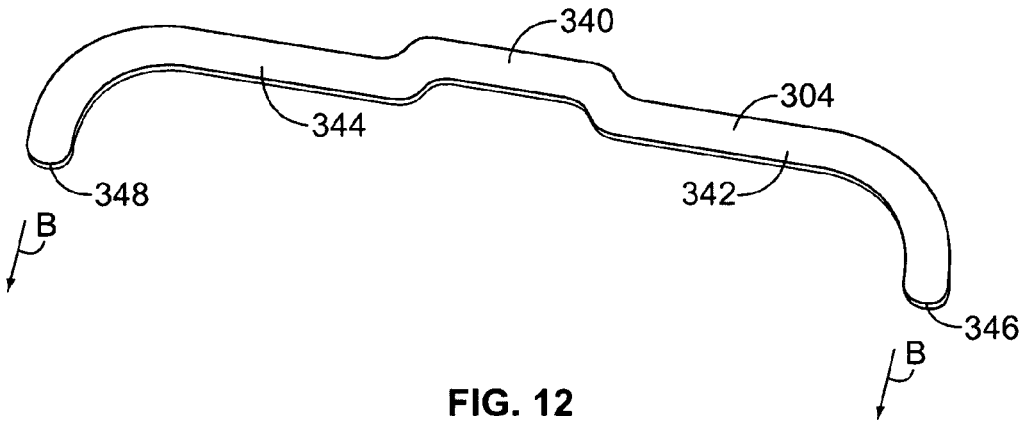
FIG. 12 is a perspective view of a conductor for use with the jumper connector shown in FIG. 11.

FIG. 12 is a perspective view of one of the conductors 304 for use with the jumper connector 300 (shown in FIG. 11). The conductor 304 includes a base 340 and two opposed arms 342, 344 extending downward from the base 340. In an exemplary embodiment, the arms 342, 344 are deflectable and define spring arms that provide a downward spring force in the direction of the arrows B. The arms 342, 344 define first and second mating interfaces 346, 348, respectively, of the conductor 304. In an exemplary embodiment, the first and second mating interfaces 346, 348 are provided at the distal ends of the arms 342, 344. The first mating interface 346 is configured to electrically engage a contact pad 52 (shown in FIG. 11) of one lighting component 22 (shown in FIG. 11). The second mating interface 348 is configured to electrically engage a contact pad 52 of a different lighting component 22. As such, the conductor 304 creates an electrical path between the two different lighting components 22.

In an exemplary embodiment, the conductor 304 is manufactured by a stamping process. The shape of the conductor 304 is stamped from a blank of stock material. No forming step is needed shape the conductor 304 into a different shape from the stamped shape.

Figure 13:
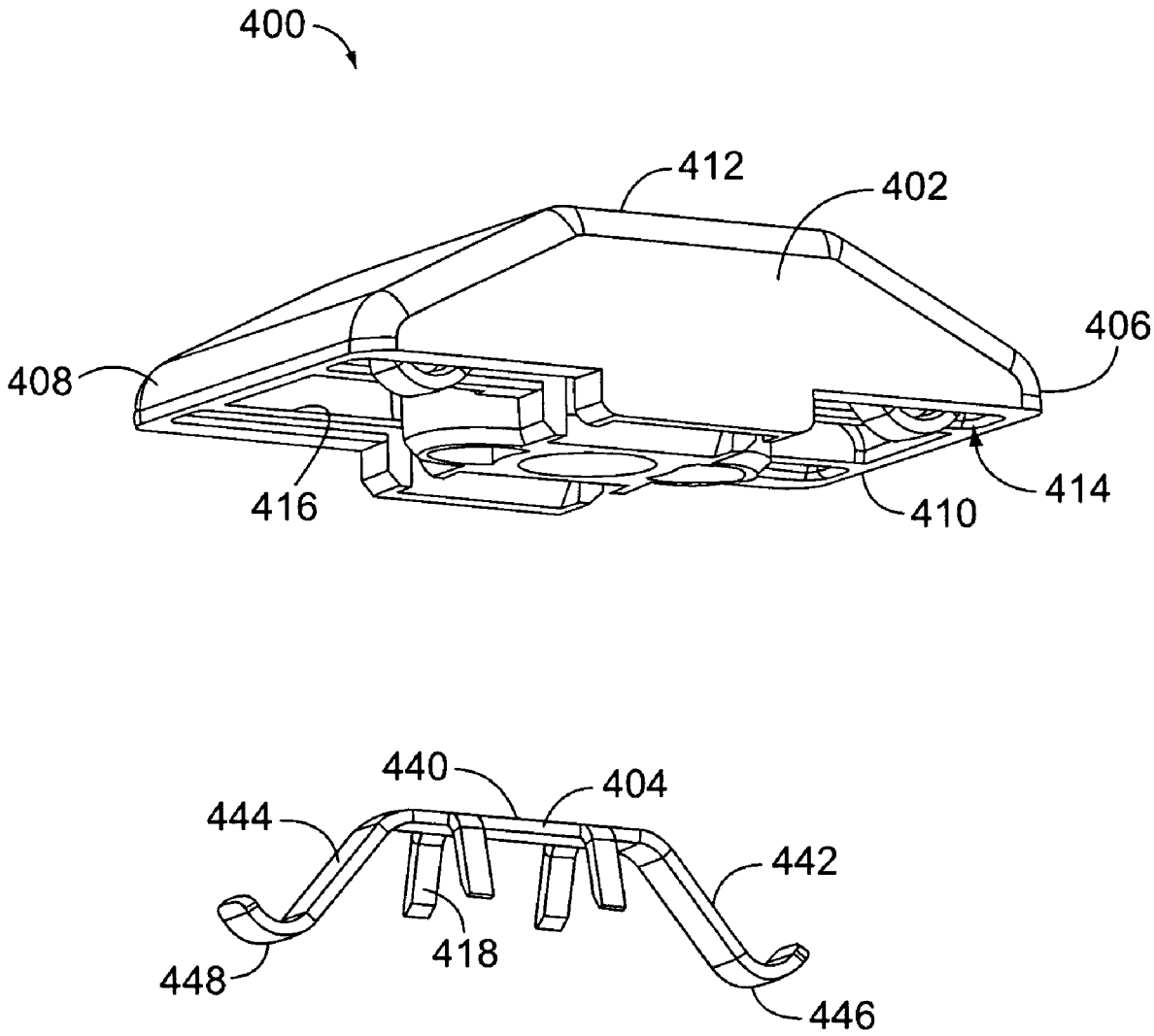

FIG. 13 is an exploded perspective view of another jumper connector 400 for the lighting assembly 20 (shown in FIG. 1). The jumper connector 400 is used to electrically connect two adjacent lighting components 22 (shown in FIG. 1) to one another. The jumper connector 400 is used to secure both lighting components 22 to the substrate 28 (shown in FIG. 1).

The jumper connector 400 includes a connector body 402 and one or more conductors 404 (shown in phantom in FIG. 11). The connector body 402 extends between opposed first and second ends 406, 408. The connector body 402 includes a mating surface 410 that generally faces the lighting components 22 and an outer surface 412 that faces away from the lighting components 22. A fastener such as the fastener 78 (shown in FIG. 1) is used to secure the jumper connector 400 to the substrate 28.

The conductors 404 are held within dedicated channels 414 formed in the connector body 402. The channels 414 are open at the mating surface 410 and the conductors 404 are loaded into the channels 414 through the mating surface 410 during an assembly process. Retention ribs 416 extend partially into the channels 414 and engage fingers 418 extending from the conductors 404 to hold the conductors 404 in the channels 414. The conductors 404 are held within the connector body 402 such that the conductors 404 are exposed at the mating surface 410 to engage the contact pads 52 (shown in FIG. 1). The conductors 404 extend between the ends 406, 408 to electrically connect the two adjacent lighting components 22 to one another.

The conductor 404 includes a base 440 and two opposed arms 442, 444 extending downward from the base 440. In an exemplary embodiment, the arms 442, 444 are deflectable and define spring arms that provide a downward spring force. The arms 442, 444 define first and second mating interfaces 446, 448, respectively, of the conductor 404. In an exemplary embodiment, the first and second mating interfaces 446, 448 are provided proximate to, or at, the distal ends of the arms 442, 444. The first mating interface 446 is configured to electrically engage a contact pad 52 of one lighting component 22. The second mating interface 448 is configured to electrically engage a contact pad 52 of a different lighting component 22. As such, the conductor 404 creates an electrical path between the two different lighting components 22.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A jumper connector for connecting lighting components to one another, the jumper connector comprising:

a connector body having a mating surface to engage more than one lighting component, the connector body being secured to a substrate by a fastener; and a conductor held by the body, wherein the conductor is to be electrically connected to more than one lighting component during the same step in which the connector body is secured to the substrate.

2. The jumper connector of claim 1, wherein the conductor is configured to engage contact pads on the lighting components when the connector body is secured to the substrate.

3. The jumper connector of claim 1, wherein the conductor creates a power circuit between the lighting components such that power is configured to flow between the lighting components via the conductor.

4. The jumper connector of claim 1, wherein the substrate constitutes a heat sink, the fastener engages the connector body and the heat sink to simultaneously secure the lighting components to the heat sink such that the lighting components are in thermal communication with the heat sink.

5. The jumper connector of claim 1, the fastener is configured to pass between adjacent lighting components, the fastener engages the connector body to secure the connector body to the substrate.

6. The jumper connector of claim 1, wherein the conductor is at least partially deflected when the fastener secures the connector body to the substrate.

7. The jumper connector of claim 1, wherein the fastener is a threaded fastener that is threadably coupled to the substrate, as the fastener is tightened the lighting components are forced against the substrate by the connector body.

8. A lighting assembly comprising:

first and second lighting components each including a circuit board extending along a longitudinal axis between opposed end portions, a contact pad provided at one or more of the end portions, a lighting device connected to the circuit board and electrically connected to at least one contact pad by the circuit board;

a jumper connector coupled between the first and second lighting components, the jumper connector having a first mating interface engaging one of the end portions of the first lighting component, the jumper connector having a second mating interface engaging one of the end portions of the second lighting component, the jumper connector having a conductor extending between the first and second mating interfaces, the conductor engaging conductive pads of both the first lighting component and the second lighting component to create an electrical circuit between the conductive pads of the first lighting component and the second lighting component, wherein the jumper connector and first and second lighting components are configured to be secured to a common substrate, wherein the circuit boards of the first and second lighting components each include an inner surface and an outer surface, the jumper connector engaging the outer surfaces of the circuit boards and simultaneously forcing the inner surfaces of the circuit boards into thermal contact with a heat sink.

9. The lighting assembly of claim 8, wherein the jumper connector includes a connector body holding the conductor, the connector body being a single piece that engages both of the first and second lighting components.

10. The lighting assembly of claim 8, wherein the conductor forms a single continuous path between the conductive pads of both the first and second lighting components, the conductor being releasably connected to the conductive pads of both the first and second lighting components.

11. The lighting assembly of claim 8, wherein the jumper connector includes a fastener engaging the jumper connector and configured to engage a substrate, wherein the jumper connector holds the first and second lighting components against the substrate when the fastener is in a securing position.

12. The lighting assembly of claim 8, wherein the circuit boards of the first and second lighting components include openings through the end portions, the circuit boards being positioned immediately adjacent one another such that the openings are aligned with one another to form a common opening, the jumper connector having a mounting tab extending therefrom, the mounting tab being received in the common opening.

13. The lighting assembly of claim 8, wherein the conductor includes first and second mating portions engaging contact pads of the first and second lighting components, wherein the mating portions are at least partially deflected when mated thereto.

14. The lighting assembly of claim 8, wherein the conductor creates a power circuit between the first and second lighting components such that power is configured to flow between the first and second lighting components via the conductor.

15. A jumper connector for connecting lighting components to one another, each lighting component having a circuit board with a lighting device mounted thereto and a contact pad thereon, the jumper connector comprising:

a connector body extending between opposed ends, the connector body having a mating surface to engage more than one lighting component;

a conductor held by the body the conductor to be electrically connected to contact pads of more than one lighting component such that the conductor creates a power path for transmitting power therebetween; and a fastener engaging the connector body, the fastener secures the connector body to a substrate when the fastener engages the substrate, wherein the connector body simultaneously secures more than one lighting component to the substrate when the fastener engages the substrate.

16. The jumper connector of claim 15, wherein the connector body includes an opening extending therethrough, the fastener extends through the opening to engage the substrate.

17. The jumper connector of claim 15, wherein the connector body includes spring fingers engaging the conductor, the spring fingers being configured to bias portions of the conductor toward the contact pads of the lighting components.

18. The jumper connector of claim 15, wherein a portion of the connector body is plated with a conductive material to define the conductor.

19. The jumper connector of claim 15, wherein run the fastener is configured to be transferred to a securing position, as the fastener is transferred to the securing position the power path is created and the connector body secures the lighting components to the substrate.

* * * * *